United States Patent [19]

Thompson

[11] Patent Number: 4,929,145

[45] Date of Patent: May 29, 1990

[54] FORKLIFT ADAPTER FOR STOCKING VERTICAL RACKS

[76] Inventor: George O. Thompson, 15917 SE. Clinton, Portland, Oreg. 97236

[21] Appl. No.: 243,429

[22] Filed: Sep. 12, 1988

[51] Int. Cl.[5] ..... B66F 9/12

[52] U.S. Cl. ..... 414/607; 414/23

[58] Field of Search ..... 414/607, 608, 23, 910, 414/911, 24.5, 24.6; 294/99.1

[56] References Cited

U.S. PATENT DOCUMENTS

| | | | |
|---|---|---|---|
| 2,684,164 | 7/1954 | Violette | 414/607 |
| 2,827,189 | 3/1958 | Knudstrup | 414/607 |
| 3,071,269 | 1/1963 | Moulds, Jr. | 414/608 |
| 3,125,236 | 3/1964 | Huff | 414/607 |
| 3,511,400 | 5/1970 | Oswald | 414/608 |
| 3,690,492 | 9/1972 | Shore | 414/607 |
| 3,785,607 | 1/1974 | Worker et al. | 414/608 X |
| 3,889,831 | 6/1975 | Davis | 414/608 X |
| 4,159,060 | 6/1979 | Buse | 414/608 |
| 4,272,220 | 6/1981 | Garcia | 414/607 |
| 4,330,231 | 5/1982 | Brewer | 414/607 X |
| 4,340,333 | 7/1982 | Casio | 414/607 |
| 4,385,860 | 5/1983 | Corbin | 414/607 X |
| 4,657,469 | 4/1987 | Beierle | 414/607 |
| 4,824,317 | 4/1989 | Schroder | 414/607 |

FOREIGN PATENT DOCUMENTS

| | | | |
|---|---|---|---|
| 137952 | 7/1950 | Australia | 414/6607 |
| 1025336 | 2/1958 | Fed. Rep. of Germany | 414/607 |
| 2422723 | 11/1974 | Fed. Rep. of Germany | 414/607 |
| 2244580 | 4/1976 | Fed. Rep. of Germany | 414/607 |
| 647244 | 2/1979 | U.S.S.R. | 414/607 |
| 1105456 | 7/1984 | U.S.S.R. | 414/607 |
| 2005221 | 4/1979 | United Kingdom | 414/607 |
| 1601686 | 11/1981 | United Kingdom | 414/607 |

OTHER PUBLICATIONS

Photograph of George Thompson's Prior Art Forklift Adapter Design.

"Drum Handling Lift Truck Attachments"-Liftomatic Material Handling, Inc., 4 pages.

*Primary Examiner*—Robert J. Spar

*Assistant Examiner*—Robert S. Katz

*Attorney, Agent, or Firm*—Klarquist, Sparkman, Campbell, Leigh & Whinston

[57] ABSTRACT

A forklift attachment adapts a forklift to handle long slender workpieces or bundles of such workpieces, such as during stocking pipe or conduit stored in vertical storage racks. The forklift adapter includes an H-shaped frame, with hollow tubular legs for receiving forks of the forklift. A cradling member is rigidly mounted to the frame for cradling the workpieces. The cradling member includes two arcuate extending arms which curve forwardly and upwardly from a plane containing the H-shaped frame, and which have a bundle receiving opening wider than the distance between the legs of the H-shaped frame. To protect the workpieces from damage during handling, the ends of the arms are rounded and the arcuate member of the cradling member has a circular cross section.

8 Claims, 1 Drawing Sheet

FORKLIFT ADAPTER FOR STOCKING VERTICAL RACKS

BACKGROUND OF THE INVENTION

The present invention relates generally to a forklift adapter, and more specifically to an improved forklift attachment for handling long slender workpieces and bundles of such workpieces stored in vertical stock storage racks.

Previous forklift adapters have had moving or rotating components which are subject to wear and malfunction upon repeated use. These forklift adapters are restricted to carrying workpieces or bundles with diameters less than the width between the forks of the forklift. Additionally, many of these earlier adapters have sharp corners which can dent and damage the workpiece during handling.

A device for handling concrete pipes with a forklift is disclosed in U.S. Pat. No. 4,340,333 to Cashio. The Cashio device must be carefully maneuvered over the end of the concrete pipe before lifting. Additionally, the Cashio device must rotate when transferring a concrete pipe between the horizontal and vertical positions. Such moving parts are subject to wear, jamming, and require periodic lubrication.

Other forklift attachments have been used for handling barrels, such as fifty-five gallon drums. For example, U.S. Pat. No. 4,385,860 to Corbin discloses a forklift attachment for lifting a barrel and then dumping the contents into a receptacle or bin. To anchor a barrel to the Corbin device, a hook must be manually placed over the rim of a barrel on the device and a chain tightened to secure the hook to the rim. This is inconvenient for a user of the device.

Another such barrel handling device for attachment to a forklift is disclosed in U.S. Pat. No. 4,272,220 to Garcia. As shown in FIGS. 1, 5 and 6, this device has curved jaws for gripping and releasing one or more barrels just below the upper rib of the barrel or barrels to lift and move the barrels. These jaws are pivoted to fork tubes mounted to the forks of a fork lift truck.

Therefore, although other forklift adapters are known, a need exists for an improved apparatus of this type for handling long slender workpieces and bundles of such workpieces.

SUMMARY OF THE INVENTION

It is an overall object of the present invention to provide an improved forklift adapter for handling long slender workpieces and bundles of such workpieces, especially when such workpieces are stored in vertical stock storage racks.

A further object of the present invention is to provide a forklift adapter which is easily mounted to the forks of a forklift truck, and easily dismounted therefrom.

An additional object of the present invention is to provide a forklift adapter capable of handling workpieces and bundles of workpieces of greater width than the width between the forks of a forklift to which the adapter is mounted.

A still further object of the present invention is to provide a forklift adapter which will minimize the risk of inadvertently denting and thereby damaging the workpiece during handling.

An additional object of the present invention is to provide a forklift adapter for handling long slender workpieces and bundles of such workpieces without requiring a forklift operator to leave the forklift controls.

Still another object of the present invention is to provide a forklift adapter which is not subject to mechanical failure or wear due to moving parts.

Another object of the present invention is to provide a forklift adapter which does not require any maintenance such as lubrication.

According to one aspect of the present invention, a forklift adapter for mounting to a forklift having at least one raiseable fork is provided to handle long slender workpieces and bundles of such workpieces. The adapter includes a frame with attachment means mounted to the frame for attaching the forklift adapter to the fork. Additionally, cradling means are rigidly mounted to the frame for cradling the workpieces during a transfer between horizontal and vertical orientations.

In an illustrated embodiment, the cradling means is an arcuate member having two arms which extend forwardly and upwardly from the frame. The frame is of an H-shape having two hollow legs which comprise one form of the attachment means. The forks of a conventional forklift truck are inserted into these legs to mount the adapter to the forklift truck.

These and other objects, features and advantages of the present invention will become apparent to those skilled in the art from the following description and drawings.

DETAILED DESCRIPTION OF A PREFERRED EMBODIMENT

Figure 1:
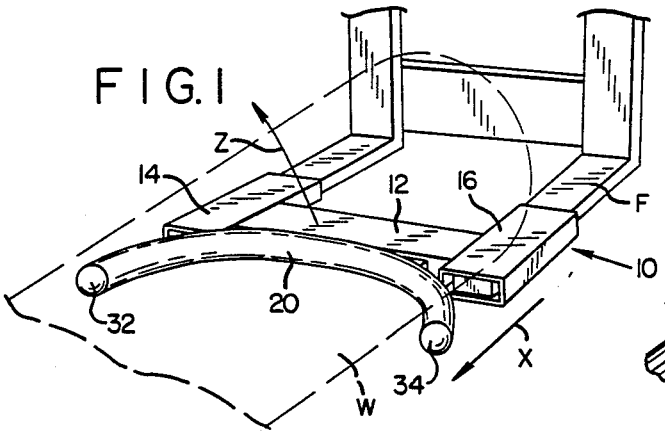
FIG. 1 is a perspective view of one form of a forklift adapter of the present invention, shown attached to the forks of a forklift truck.

Referring to FIG. 1, a forklift adapter or attachment 10 has a frame 12 with attachment means, such as first and second fork mounting means 14 and 16. The fork mounting means 14, 16 are mounted to frame 12 for attaching the adapter 10 to the forks F of a forklift, such as forklift truck T shown in FIGS. 2 and 3. The forklift adapter 10 also includes cradling means 20 rigidly mounted to frame 12 for cradling a long slender workpiece or a bundle of such workpieces W during various material handling operations. Typical workpieces include pipe, electrical conduit, angle iron, reinforcing rod, and lumber.

The, illustrated embodiment of adapter 10 is particularly useful for transferring the workpiece W between horizontal and vertical orientations. Such a transfer occurs when the workpiece W is stacked in a vertical position in a vertical stock storage rack R, as shown in FIG. 3.

Figure 2:
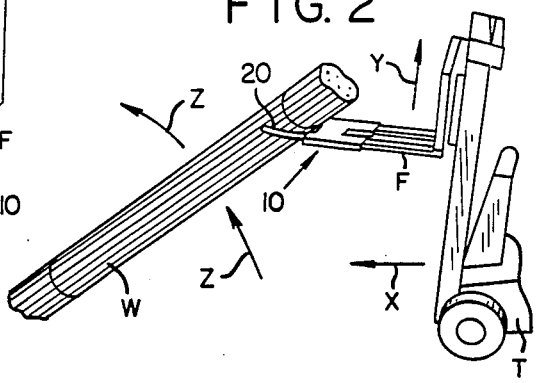
FIG. 2 is a perspective view of the forklift adapter of the present invention mounted to a forklift truck, shown raising a bundle of long slender workpieces from a horizontal to a vertical position.

For example, FIG. 1 shows workpiece W in dashed lines in a horizontal position as it is being picked up by the forklift adapter 10 as the forklift, and thereby the adapter, moves in the direction indicated by arrow X. Referring to FIGS. 2 and 3, the forklift truck T moves in the forward direction indicated by arrow X, while simultaneously raising the forks F and hence the adapter 10 in the direction indicated by arrow Y. During these simultaneous motions of the forklift truck T, the workpiece W is lifted along the path indicated by arrows Z from a horizontal to a vertical position.

Figure 3:
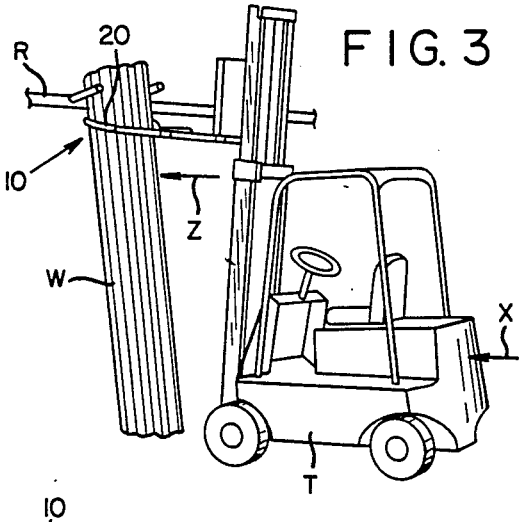
FIG. 3 is a perspective view of the forklift adapter of the present invention attached to a forklift truck, shown placing a bundle of long slender workpieces into a vertical storage rack.

As shown in FIG. 3, the workpiece is actually stored at an angle slightly past the vertical point to allow it to rest upon storage rack R in a more stable position. If the workpiece is stored in this manner, the workpiece is tipped manually or otherwise to angle outwardly from the rack and is received by the cradle, and the stocking. procedure is reversed to remove workpiece W from rack R and into the horizontal position for transport to a different location.

Figure 4:
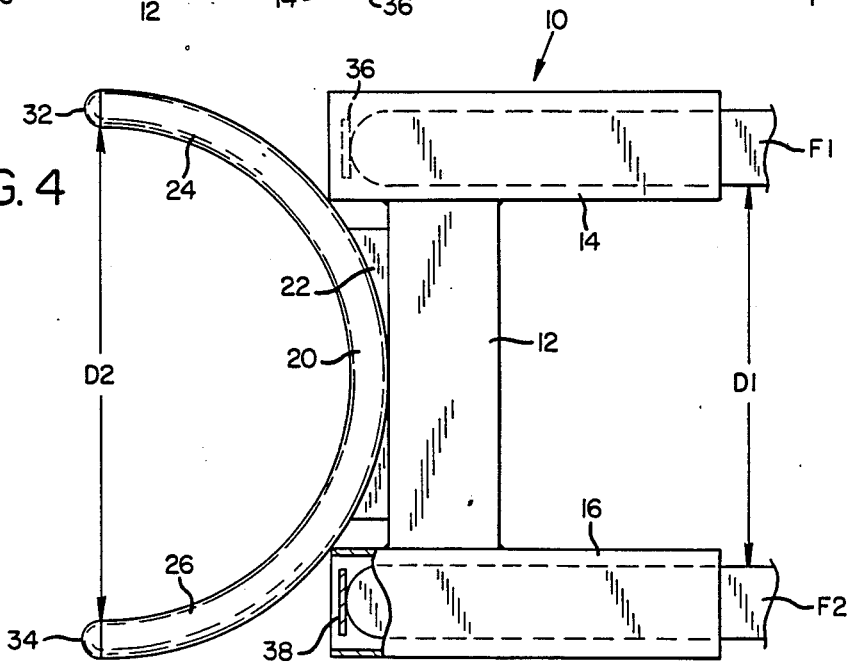
FIG. 4 is a partially broken away top plan view of one form of a forklift adapter of the present invention, shown mounted to the forks of a forklift.

In an illustrated embodiment shown in FIG. 4, the cradling means 20 is a semicircular, arcuate member having a central region that is rigidly mounted to frame 12. This rigid mounting can be accomplished by a variety of means, such as by welding this central region to a mounting plate 22, which is in turn welded to frame 12. Additional reinforcement can be provided by welding cradling means 20 to the ends of attachment means 14 and 16.

Figure 5:
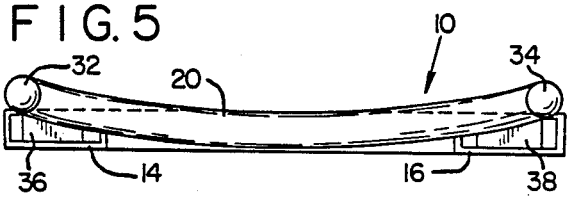
FIG. 5 is a front view of a forklift adapter.
Figure 6:
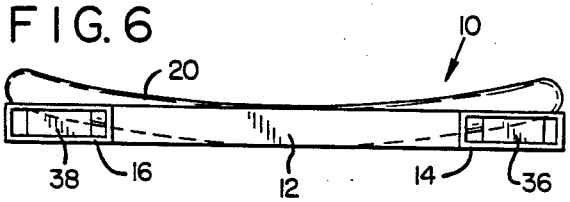
FIG. 6 is a rear view of the forklift adapter of FIG. 4.
Figure 7:
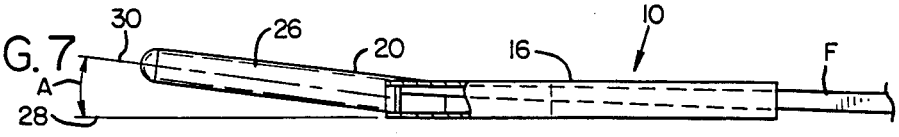
FIG. 7 is a partially broken away side elevational view of the forklift adapter of FIG. 4.

As shown in FIGS. 5, 6 and 7, the central region of cradling means 20 lies substantially within a first plane, identified as plane 28 in FIG. 7, defined by frame 12. The cradling means 20 includes two arms, such as arcuate extending arms 24, 26 extending forwardly and upwardly from frame 12. Arms 24, 26 bend upwardly from first plane 28 in a direction defined by an angle A. The distal ends of these arms lie substantially within a second plane 30. For handling bundles of pipe, fixing angle A at approximately 20° has proved to be particularly advantageous because bundles W may be lifted from the horizontal position when resting either directly upon the ground, upon blocks, or upon pallets.

To aid in preventing damage to the workpiece W during handling, the cradling means 20 is of a circular cross section, as best shown in FIG. 5. During transfer of the workpiece W between horizontal and vertical orientations, the workpiece rolls gently along the surface of the circular cross section of cradling means 20. This feature advantageously minimizes damage to the workpiece from dents caused by sharp edges or corners as encountered in other devices. To further minimize damage to workpiece W during the initial lifting, arms 24, 26 of cradling means 20 terminate at ends 32, 34, respectively, which are rounded (see FIG. 4).

In an illustrated embodiment, frame 12 is of an H-shape with mounting plate 22 welded to a crosspiece of the frame. The illustrated attachment means 14, 16 comprises legs of the H-shaped frame 12 which are hollow and tubular in nature to slidably receive the forks F of a forklift T. As shown in FIG. 6, each of the hollow legs 14, 16 have a rectangular cross section, sized in cross sectional dimension to be slightly larger than the respective forks F.

For a forklift having right and left forks designated F1 and F2 as shown in FIG. 4, the fork mounting legs 14 and 16 can likewise be designated right and left, respectively. The forks are shown transversely separated by a first distance D1, which corresponds to the distance between the right and left legs 14, 16.

Stops 36, 38 are welded in place near the end of respective legs 14, 16 closest to cradling means 20. These stops 36, 38 allow an operator of forklift T to determine that the forks F have obtained maximum engagement within the attachment legs 14, 16 without leaving the forklift controls. Additionally, stops 36, 38 prevent the forks F from extending beyond legs 14, 16 and interfering with or possibly damaging workpiece W. In the illustrated embodiment, stops 36, 38 are plates slightly inset within the ends of the legs and welded in place.

In an illustrated embodiment, cradling means 20 extends in a forward direction beyond H-shaped frame 12 and beyond the end of the fork F when adapter 10 is mounted to forklift T. Additionally, cradling means 20 has a bundle receiving opening D2 between ends 32 and 34. The placement of cradling means 20 in a forward direction beyond frame 12 allows the bundle receiving opening D2 to be wider than the first distance D1 between the forks F1 and F2. These features advantageously allow the forklift attachment 10 to handle workpieces W which are wider in diameter or cross sectional dimension than the restricting distance D1 between the right and left forks Fl, F2.

Having illustrated and described the principals of the invention with respect to a preferred embodiment, it should be apparent to those skilled in the art that my invention may be modified in arrangement and detail without departing from such principals.

I claim all such modifications falling within the spirit and scope of the following claims.

1. A forklift adapter for mounting to a forklift having at least one raisable fork positioned generally in a first plane, the mounted adapter to handle long slender workpieces and bundles of such workpieces, the adapter comprising:

a frame;

attachment means positioned generally in the first plane and mounted to the frame for attaching the forklift adapter to the forks; and cradling means rigidly mounted to the frame for cradling a long slender workpiece or bundle of such workpieces during a transfer of the workpiece between horizontal and vertical orientations, the cradling means being an arcuate member having a central region rigidly mounted to the frame in the first plane and having two arcuate extending arms curved upwardly above the first plane.

2. A forklift adapter according to claim 1 wherein the cradling means extends in a forward direction beyond the end of the fork.

3. A forklift adapter according to claim 1 wherein the two arcuate extending arms extend forwardly and upwardly from the frame.

4. A forklift adapter according to claim 1 wherein the ends of the two arcuate extending arms are rounded.

5. A forklift adapter according to claim 1 for a forklift having right and left forks which are spaced-apart a first distance and wherein the distance between the two arcuate extending arms is greater than the first distance.

6. A forklift adapter according to claim 1 wherein the arcuate member has a circular cross section.

7. A forklift adapter according to claim 1 wherein the attachment means is a hollow tubular member sized in crosssectional dimension to be slightly larger than the fork, whereby the tubular member slidably receives the fork.

8. A forklift adapter according to claim 7 for a forklift having right and left forks, wherein the attachment means further includes right and left hollow tubular members sized in cross section for slidable attachment to the respective right and left forks.

* * * * *